United States Patent [19]

Brand et al.

[11] 4,295,295

[45] Oct. 20, 1981

[54] PICK-UP SHOE AND MOTOR CONTACT ASSEMBLY FOR TOY VEHICLE

[75] Inventors: Derek A. Brand, Camarillo; Derek R. Brand, Carpenteria, both of Calif.

[73] Assignee: Tyco Industries, Inc., Moorestown, N.J.

[21] Appl. No.: 130,757

[22] Filed: Mar. 17, 1980

[51] Int. Cl.[3] ..... A63H 18/12; F42B 13/34; H02K 21/26

[52] U.S. Cl. ..... 46/259; 104/60; 310/154

[58] Field of Search ..... 46/259, 257, 221, 258, 46/261, 260; 104/305, 304, 60, 66, 288, 295, 151; 310/154; 273/86 B

[56] References Cited

U.S. PATENT DOCUMENTS

| | | | |
|---|---|---|---|
| 2,465,224 | 3/1949 | Hansen et al. | 310/154 |
| 3,234,417 | 2/1966 | Somers et al. | 310/154 |
| 3,243,917 | 4/1966 | Giammarino et al. | 46/257 |
| 3,373,524 | 3/1968 | Nirenberg | 104/60 |
| 3,774,340 | 11/1973 | Barlow et al. | 46/259 |
| 4,136,485 | 1/1979 | Jones et al. | 46/257 |

*Primary Examiner*—Gene Mancene
*Assistant Examiner*—Michael J. Foycik, Jr.
*Attorney, Agent, or Firm*—Seidel, Gonda, Goldhammer & Panitch

[57] ABSTRACT

A single conductive spring resiliently biases a pick-up shoe against a track rail while resiliently biasing a brush arm against the motor commutator segments. The spring provides an electrical current path between the pick-up shoe and brush arm.

26 Claims, 6 Drawing Figures

FIG. 4
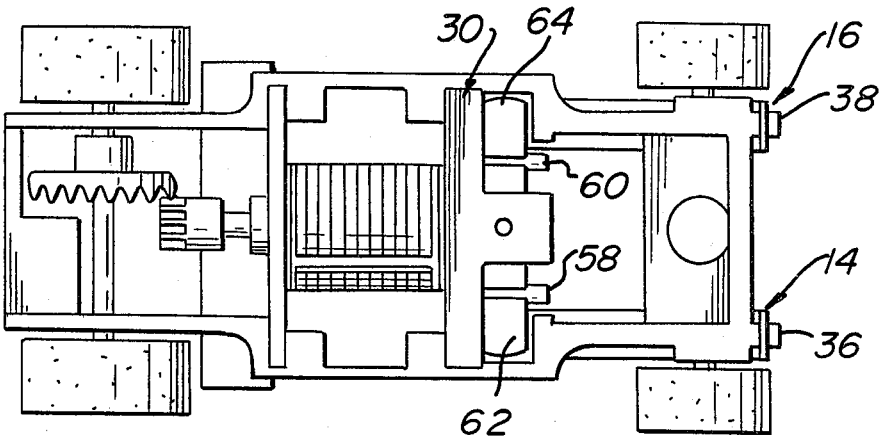
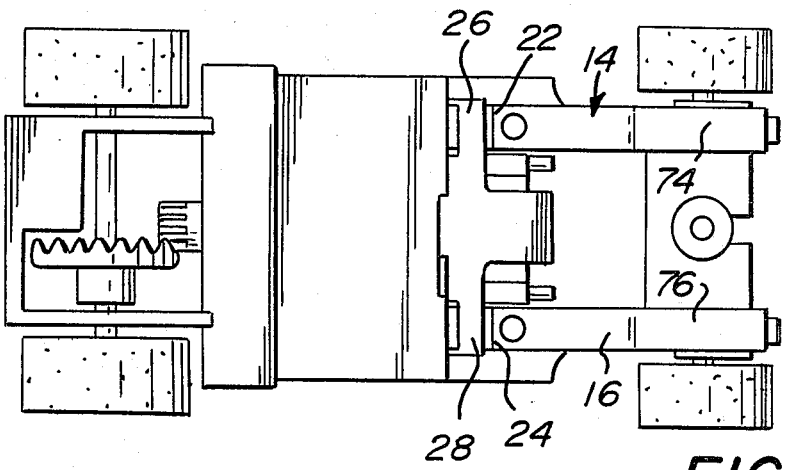
FIG. 5
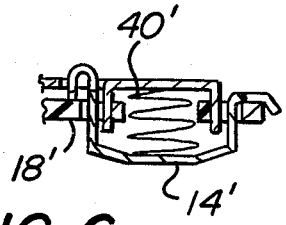
FIG. 6

PICK-UP SHOE AND MOTOR CONTACT ASSEMBLY FOR TOY VEHICLE

BACKGROUND

The invention is directed to a pick-up shoe and motor contact assembly for a toy vehicle. Heretofore, various assemblies of the pick-up shoes and contacts (brushes) of electrically powered motor driven toy vehicles have been proposed. Such assemblies entail various designs for the electrical connection and mechanical mounting of the pick-up shoes and brushes.

For example, U.S. Pat. No. 4,031,661 for "Miniature Vehicle With Magnetic Enhancement of Traction" to Robert B. Bernhard discloses an assembly wherein the pick-up shoe is hinged on a spring clip wrapped around a cylinder. The cylinder houses a spring-urged motor brush. A coil spring contacts the spring clip (underside) and presses the pick-up shoe against the track rail. The coil spring conducts electricity from the rail to the clip, but separate springs are required for the motor brush and the pick-up shoe.

Another assembly is disclosed in U.S. Pat. No. 3,243,917 for "Electrical Motor Operated Toy Vehicle" to Joseph E. Giammarino et al. The assembly includes a pick-up shoe, pick-up holder, brush spring (leaf spring) and motor brush. A coil spring presses the pick-up shoe against the track rail but does not contact the brush spring or the motor brush.

U.S. Pat. No. 3,307,292 for "Steering and Current Pickup Means for Miniature Racing Car" to Eugene W. Fileger discloses an assembly wherein the pick-up shoes are located on a rotatable platform used for steering the toy vehicle. A conductive central cylinder is located on the front platform. A leaf spring biases the pick-up shoe into contact with the track and contacts a base contact provided with a brush spring which contacts the commutator segments of the motor. The brush spring is not spring-urged against the commutator segment.

U.S. Pat. No. 3,774,340 for "System for Operating Miniature Vehicles" to Gordon A. Barlow et al discloses another type of assembly wherein a spring biased pick-up shoe is held by a bracket riveted to the base of the toy vehicle. The bracket includes a flanged portion which carries the motor brush.

The foregoing types of assemblies can become rather intricate, the proliferation of components and their relative placement increasing the costs of manufacture.

An advantage of the present invention is that the pick-up shoe and motor contact assembly comprises relatively few parts, reducing the cost of manufacture without adversely affecting reliability.

Other advantages appear here and after.

SUMMARY OF THE INVENTION

A pick-up shoe and motor contact assembly for a toy vehicle including a conductive pick-up shoe for contacting a conductive track rail, a pivotably mounted conductive brush arm provided with a brush for contacting the commutator segments of the toy vehicle motor, and a single conductive spring which contacts the pick-up shoe and the brush arm, providing an electrical path therebetween while urging the pick-up shoe against the track rail and biasing the brush arm so that the brush presses against the motor commutator segments.

For the purpose of illustrating the invention, there is shown in the drawings a form which is presently preferred; it being understood, however, that this invention is not limited to the precise arrangements and instrumentalities shown.

BRIEF DESCRIPTION OF THE DRAWINGS

FIG. 4 is a top plan view of the toy vehicle.

FIG. 5 is a bottom plan view of the toy vehicle.

FIG. 6 is a side elevation of an alternative embodiment of a pick-up shoe in the assembly of the present invention.

DETAILED DESCRIPTION OF THE INVENTION

Figure 1:
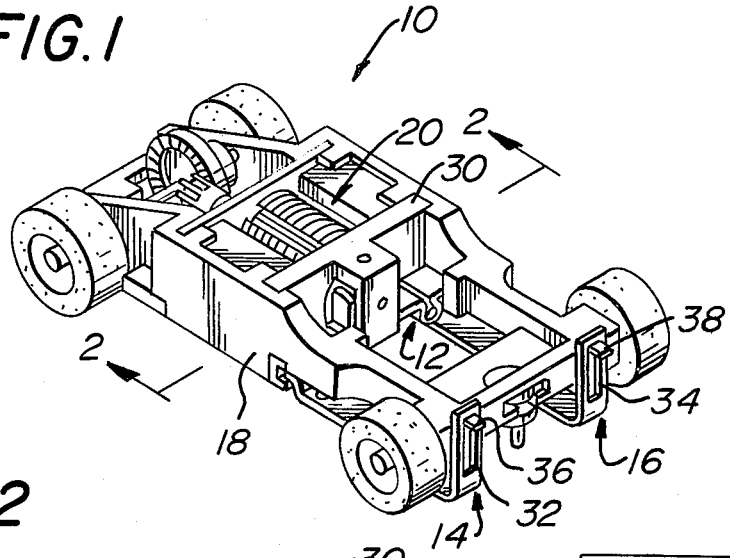
FIG. 1 is an isometric of the toy vehicle provided with the pick-up shoe and motor contact assembly of the present invention.

Referring to the drawings, wherein like numerals indicate like elements, there is shown in FIG. 1 a toy vehicle 10 provided with the pick-up shoe and motor contact assembly 12 of the present invention. The assembly 12 includes a pair of pick-up shoes 14, 16 mounted on the vehicle chassis 18. The toy vehicle may be of the slot or slotless type and rides in a conventional track surface having two or more conductive rails 19, 21. Each of the pick-up shoes 14, 16 is conductive and respectively contacts a track rail 19, 21. The track rails are connected to a power source which provides power for the vehicle motor 20.

Pick-up shoes 14, 16 are respectively provided with hook portions 22, 24. Hook portions 22, 24 respectively rest on struts 26, 28 formed in the chassis support wall 30. Struts 26, 28 provide aligned transverse axes about which the pick-up shoes 14, 16 are respectively able to pivot.

The pick-up shoes 14, 16 are respectively provided with eyes or openings 32, 34 at their front portions. Openings 32, 34 respectively accommodate fingers 36, 38 integral with and protruding from the vehicle chassis 18. The fingers 36, 38 prevent lateral displacement of the pick-up shoes 14, 16 to maintain alignment of the shoes and track rails.

Figure 3:
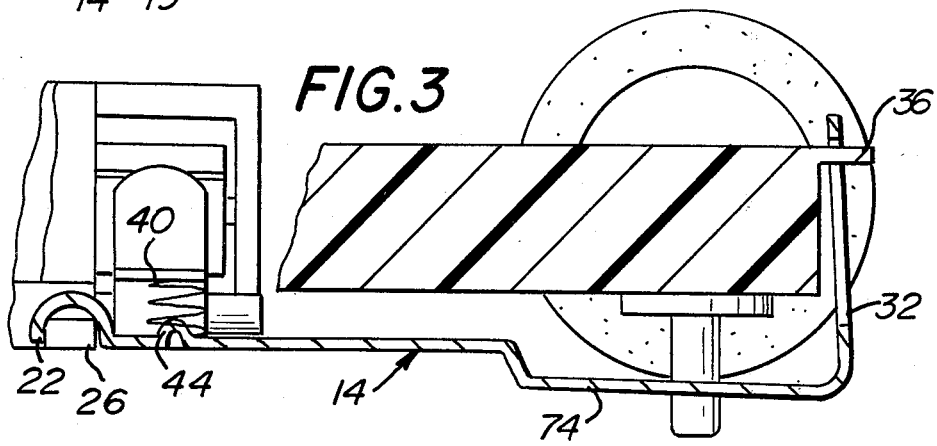
FIG. 3 is a side elevation of the toy vehicle with part of the chassis broken away.

Conductive coil springs 40, 42 are respectively mounted in contact relation on the pick-up shoes 14, 16. Coil springs 40, 42 cushion pivotal displacement of the pick-up shoes to accommodate bumps or other track irregularities as the toy vehicle 10 travels there along. As shown in FIG. 3, the coil springs 40, 42 are spaced forwardly of the struts 26, 28 to impart a moment about the axes of the struts which downwardly biases the pick-up shoes 14, 16 against the track rails. To accommodate the coil springs 40, 42, the top sides of the pick-up shoes 14, 16 are respectively provided with raised portions 44, 46 formed by dimpling the undersides of the pick-up shoes. Each raised portion restrains lateral movement of the associated coil spring seated thereon.

Figure 2:
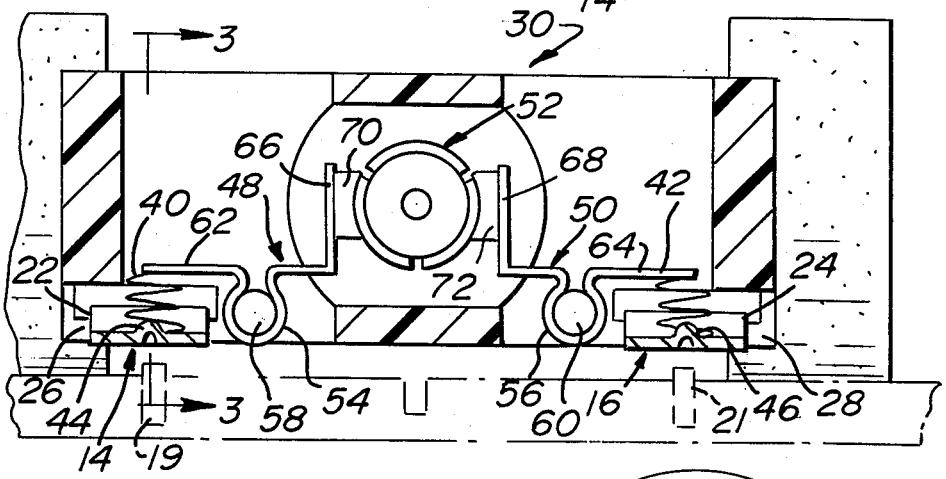
FIG. 2 is a front section of the toy vehicle showing the assembly of the present invention.

A pair of conductive brush arms 48, 50 are respectively positioned on each side of the commutator segments 52 of the vehicle motor 20. As best shown in FIG. 2, the brush arms 48, 50 are respectively provided with bight portions 54, 56. Each bight portions 54, 56 is respectively partially wrapped about fingers 58, 60 which are integral with and protrude from the chassis support wall 30. The fingers 58, 60 extend along longitudinal axes parallel with the rotor shaft of motor 20. The fingers 58, 60 provide spaced parallel axes about which the brush arms 48, 50 respectively pivot. Preferably, the support wall 30 is made of a polymeric plastic material, as are fingers 58, 60, to offer reduced surface friction to the pivotal movement of the brush arms.

The brush arms 48, 50 are respectively provided with flanges 62, 64 which face the sides of the vehicle chassis 18. The flanges 62, 64 respectively contact the coil springs 40, 42 as best shown in FIG. 2. The brush arms 48, 50 are also respectively provided with upwardly extending tab portions 66, 68 proximal to the commutator segments 52 of the vehicle motor 20. Secured to the inner face of tab portion 66 is a cylindrical stub contact or brush 70. Secured to the inner face of tab portion 68 is an identical contact or brush 72. Brushes 70, 72 are conductive and are maintained in contact relation with the commutator segments 52 by means of the biasing moments exerted by coil springs 40, 42 bearing upwardly against the brush arm flanges 62, 64.

When the toy vehicle 10 is placed on the track, the end portions 74, 76 of the pick-up shoes contact the track rails, causing the pick-up shoes to pivot slightly upwardly thereby exerting a compressive force on the coil springs 40, 42. The springs 40, 42, being sandwiched respectively between the flanges 62, 64 and the pick-up shoes 14, 16, maintain the brush arms 48, 50 pivoted towards the commutator segments 52 so that the brushes 70, 72 are maintained in good contact relation with the commutator segments. At the same time, the springs 40, 42 press downwardly against the pick-up shoes to maintain the pick-up shoes in good contact relation with the rails.

From the foregoing, it should be appreciated that the pick-up shoe and motor contact assembly 12 of the present invention comprises a minimal number of parts, making it relatively simple to manufacture, and insures reliable electrical contact between the commutator segments 52 and brushes 70, 72 as well as reliable electrical contact between the pick-up shoes 14, 16 and the track rails.

The specific embodiment of the invention described herein may be modified without exceeding the spirit or scope of the invention. For example, the pick-up shoes 14, 16 may be pivotably mounted on a portion of the underside of the chassis itself. In addition, instead of pivotably mounting the pick-up shoes on the vehicle the shoes may be suspended from the vehicle chassis under pressure of the coil springs, as indicated in FIG. 6, the relationship between the coil springs and the brush arms otherwise remaining the same. Further, the relationship between the coil springs and brush arms may be varied to bias the brushes against the commutator segments in any other manner, the same coil springs being used to bias the pick-up shoes against the track rails as already explained.

The present invention may be embodied in other specific forms without departing from the spirit or essential attributes thereof and, accordingly, reference should be made to the appended claims, rather than to the foregoing specification, as indicating the scope of the invention.

I claim:

1. A pick-up shoe and motor contact assembly for a toy vehicle having a chassis and a motor for powering the vehicle, the motor having commutator segments, comprising:

a least one conductive brush arm for contacting the commutator segments of the motor, said brush arm being moveable with respect to the motor commutator segments, at least one conductive pick-up shoe depending from the vehicle chassis, resilient means disposed in contact relation with said pick-up shoe and said brush arm for resiliently urging said pick-up shoe downwardly while resiliently urging said brush arm against the motor commutator segments, said resilient means being adapted to conduct electrical current between said pick-up shoe and brush arm.

2. The assembly according to claim 1 wherein said brush arm is pivotably mounted on the vehicle chassis.

3. The assembly according to claim 1 wherein said brush arm includes a flange in contact relation with said resilient means, a tab portion proximal to the motor commutator segments, a conductive contact secured to said tab portion for contacting the motor commutator segments, and a bight portion intermediate said flange and tab portion, said brush arm being mounted at said bight portion for pivotal movement with respect to said motor commutator segments.

4. The assembly according to claim 1 wherein said resilient means is a coil spring.

5. The assembly according to claim 4 wherein said pick-up shoe is suspended from the vehicle chassis under pressure of said coil spring.

6. The assembly according to claim 1 wherein said pick-up shoe is pivotably mounted on the vehicle chassis.

7. A pick-up shoe and motor contact assembly for a toy vehicle having a chassis and a motor for powering the vehicle, the motor having commutator segments, comprising:

at least one conductive pick-up shoe pivotably mounted on said chassis, said pick-up shoe having an end portion mounted on said chassis to prevent lateral displacement of the pick-up shoe, a support member, at least one conductive brush arm having a first end portion proximal to the motor commutator segments, an intermediate portion pivotably mounted on said support member, and a second end portion distal from the motor commutator segments, and resilient means mounted in contact relation between said brush arm second end portion and said pick-up shoe, said resilient means being adapted to conduct electrical current between said pick-up shoe and brush arm, whereby said resilient means pivotably urges said brush arm first end portion against said motor commutator segments while pivotably urging said pick-up shoe downwardly with respect to the vehicle chassis.

8. The assembly according to claim 7 wherein said resilient means is a coil spring.

9. The assembly according to claim 7 wherein said brush arm includes a conductive contact secured to said first end portion for contacting the motor commutator segments.

10. The assembly according to claim 9 wherein said conductive contact is a cylindrical stub contact.

11. The assembly according to claim 7 wherein said support member is integral with said vehicle chassis.

12. A pick-up shoe and motor contact assembly for a toy vehicle having a chassis and a motor for powering the vehicle, the motor having commutator segments, comprising:

at least one conductive brush arm for contacting the commutator segments of the motor, at least one conductive pick-up shoe suspended from the chassis, and conductive means in contact relation with said brush arm and pick-up shoe for urging said brush arm into contact with said motor commutator segments while urging said pick-up shoe downwardly with respect to the chassis and for conducting current between said shoe and said arm.

13. The assembly according to claim 12 wherein said conductive means is a coil spring.

14. The assembly according to claim 12 wherein said pick-up shoe is pivotably mounted on the vehicle chassis.

15. The assembly according to claim 12 including a support member, said brush arm being pivotably mounted on said support member.

16. A toy vehicle having a chassis and a motor for powering the toy vehicle, the motor having commutator segments, comprising:

first and second assemblies, each of which comprises at least one conductive brush arm for contacting the motor commutator segments, at least one conductive pick-up shoe suspended from the chassis, and conductive means in contact with said brush arm and pick-up shoe for urging said brush arm into contact with said motor commutator segments while urging said pick-up shoe downwardly with respect to the chassis and for conducting current between said shoe and said arm.

17. The toy vehicle according to claim 16 wherein said conductive means is a coil spring.

18. A toy vehicle having a chassis and a motor for powering the toy vehicle, the motor having commutator segments, comprising:

first and second assemblies, each of which comprises first conductive means for contacting the motor commutator segments, second conductive means suspended from the chassis, and third conductive means in contact with said first and second means for urging said first means into contact with said commutator segments while urging said second means downwardly with respect to the chassis and for conducting current between said first and second means.

19. The toy vehicle according to claim 18 wherein said third conductive means includes a coil spring.

20. The assembly according to claim 1, wherein said resilient means is a coil spring having two free ends, one of said free ends being disposed in contact relation with said pick-up shoe to resiliently urge said pick-up shoe downwardly and the other free end being disposed in contact relation with said brush arm to resiliently urge said brush arm against the motor commutator segments.

21. The assembly according to claim 7, wherein said resilient means is a coil spring having two free ends, one of said free ends being disposed in contact relation with said brush arm to pivotably urge said brush arm first end portion against said motor commutator segments and the other free end being disposed in contact relation with said pick-up shoe to pivotably urge said pick-up shoe downwardly with respect to the vehicle chassis.

22. The assembly according to claim 12, wherein said conductive means is a coil spring having two free ends, one of said free ends being disposed in contact relation with said brush arm to urge said brush arm into contact with said motor commutator segments and the other free end being disposed in contact relation with said pick-up shoe to urge said pick-up shoe downwardly with respect to the vehicle chassis.

23. The assembly according to claim 16, wherein said conductive means is a coil spring having two free ends, one of said free ends being disposed in contact relation with said brush arm to urge said brush arm into contact with said motor commutator segments and the other free end being disposed in contact relation with said pick-up shoe to urge said pick-up shoe downwardly with respect to the vehicle chassis.

24. The assembly according to claim 18, wherein said conductive means is a coil spring having two free ends, one of said free ends being disposed in contact relation with said brush arm to urge said brush arm into contact with said motor commutator segments and the other free end being disposed in contact relation with said pick-up shoe to urge said pick-up shoe downwardly with respect to the vehicle chassis.

25. A pick-up shoe and motor contact assembly for a toy vehicle having a chassis and a motor for powering the vehicle, the motor having commutator segments, comprising:

at least one conductive brush arm for contacting the commutator segments of the motor, said brush arm being mounted for pivotable movement with respect to the motor commutator segments about an axis substantially parallel to the axis of rotation of the motor commutator segments;

at least one conductive pick-up shoe depending from the vehicle chassis, said pick-up shoe being mounted for pivotable movement with respect to the vehicle chassis about an axis substantially orthogonal to and displaced from the axis of rotation of said brush arm;

resilient means disposed between said brush arm and said pick-up shoe, said resilient means having two free ends, one of said ends being disposed in contact relation with said brush arm to urge the brush arm against the motor commutator segments and the other of said ends being disposed in contact relation with said pick-up shoe to urge the pick-up shoe downwardly with respect to the vehicle chassis, said resilient means being adapted to conduct electrical current between said pick-up shoe and said brush arm.

26. The assembly according to claim 25, wherein said resilient means is a coil spring arranged in contact with said brush arm and pick-up shoe to exert oppositely directed forces against said brush arm and pick-up shoe.

* * * * *